US011193234B2

(12) United States Patent
Lee et al.

(10) Patent No.: US 11,193,234 B2
(45) Date of Patent: Dec. 7, 2021

(54) LAUNDRY TREATING APPARATUS

(71) Applicant: LG Electronics Inc., Seoul (KR)

(72) Inventors: Jihong Lee, Seoul (KR); Jinwoo Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 136 days.

(21) Appl. No.: 15/880,776

(22) Filed: Jan. 26, 2018

(65) Prior Publication Data

US 2019/0024293 A1 Jan. 24, 2019

(30) Foreign Application Priority Data

Jul. 19, 2017 (KR) ..... 10-2017-0091521

(51) Int. Cl.
*D06F 39/02* (2006.01)
*D06F 39/08* (2006.01)
*D06F 29/00* (2006.01)

(52) U.S. Cl.
CPC ..... *D06F 39/088* (2013.01); *D06F 39/028* (2013.01); *D06F 29/00* (2013.01); *D06F 39/02* (2013.01)

(58) Field of Classification Search
CPC ..... D06F 39/022; D06F 39/088; D06F 39/02; D06F 29/00
See application file for complete search history.

(56) References Cited

U.S. PATENT DOCUMENTS 5,172,713 A 12/1992 Hall
2007/0044517 A1 3/2007 Yang et al.
2009/0053119 A1 2/2009 Richman et al.
2009/0145176 A1 6/2009 Kim et al.
2009/0145177 A1* 6/2009 Kim ..... D06F 39/125 68/13 R
2011/0023241 A1 2/2011 Lim et al.
2011/0154865 A1* 6/2011 Lee ..... D06F 39/02 68/200

(Continued)

FOREIGN PATENT DOCUMENTS

CN 201136989 Y 10/2008
CN 103866537 6/2014

(Continued)

OTHER PUBLICATIONS

CN104790168A—Machine translation (Year: 2015).*

(Continued)

*Primary Examiner* — Tinsae B Ayalew
(74) *Attorney, Agent, or Firm* — Fish & Richardson P.C.

(57) ABSTRACT

A laundry treating apparatus includes a tub, a drum, a detergent supply unit, a connection pipe, first and second water supply pipes, a supply unit water supply pipe, a housing defining a chamber configured to receive water from the first water supply pipe. The housing defines a first path connected to the first water supply pipe, a second path connected to the second water supply pipe, and a third path connected to the supply unit water supply pipe. The apparatus further includes a first valve configured to open and close the first water supply pipe or the first path, a second valve configured to open and close the third path, a second tub arranged above or below the tub, a second drum, a second tub water supply pipe, and a second tub water supply pipe valve.

25 Claims, 10 Drawing Sheets

(56) References Cited

U.S. PATENT DOCUMENTS

| | | | | |
|---|---|---|---|---|
| 2012/0024021 | A1 | 2/2012 | Seo et al. | |
| 2012/0125055 | A1 | 5/2012 | Lee | |
| 2013/0086754 | A1 | 4/2013 | Hendrickson et al. | |
| 2013/0117943 | A1 | 5/2013 | Kim | |
| 2013/0145562 | A1 | 6/2013 | Lee et al. | |
| 2013/0263630 | A1 | 10/2013 | Doh et al. | |
| 2014/0373284 | A1 | 12/2014 | Leibman et al. | |
| 2015/0114046 | A1* | 4/2015 | Jeong | D06F 39/088 68/17 R |
| 2015/0135780 | A1 | 5/2015 | Ajiki et al. | |
| 2015/0368850 | A1 | 12/2015 | Seo et al. | |
| 2016/0032517 | A1 | 2/2016 | Lee et al. | |
| 2016/0194812 | A1 | 7/2016 | Pollett | |
| 2017/0037558 | A1 | 2/2017 | Dunsbergen et al. | |

FOREIGN PATENT DOCUMENTS

| | | | |
|---|---|---|---|
| CN | 104790168 | | 7/2015 |
| CN | 106319820 | | 1/2017 |
| EP | 2607544 | | 6/2013 |
| EP | 2141276 | | 2/2014 |
| GB | 1071732 | | 6/1967 |
| GB | 2138451 | | 10/1984 |
| JP | 2001276480 | A | 10/2001 |
| JP | 2004-313318 | | 11/2004 |
| KR | 217128 | A | 9/1999 |
| KR | 2005014506 | A | 2/2005 |
| KR | 1020100004728 | | 10/2010 |
| KR | 2014130931 | A | 11/2014 |
| KR | 2015025083 | A | 3/2015 |
| KR | 2015058605 | A | 5/2015 |
| KR | 1020150072169 | | 6/2015 |
| KR | 2017002879 | A | 1/2017 |
| WO | 2015/143912 | | 10/2015 |
| WO | WO2016169526 | | 10/2016 |
| WO | 2017/107359 | | 6/2017 |

OTHER PUBLICATIONS

European Search Report in European Application No. 17197476.9, dated Oct. 1, 2018, 25 pages.
Partial European Search Report in European Application No. 17197476.9, dated Jun. 13, 2018, 18 pages.
Australian Office Action in Australian Application No. 2017248484, dated Jun. 26, 2019, 8 pages.
Chinese Office Action in Chinese Application No. 201810783385.1, dated Jul. 1, 2020, 21 pages (with English translation).

* cited by examiner

【Fig. 1】
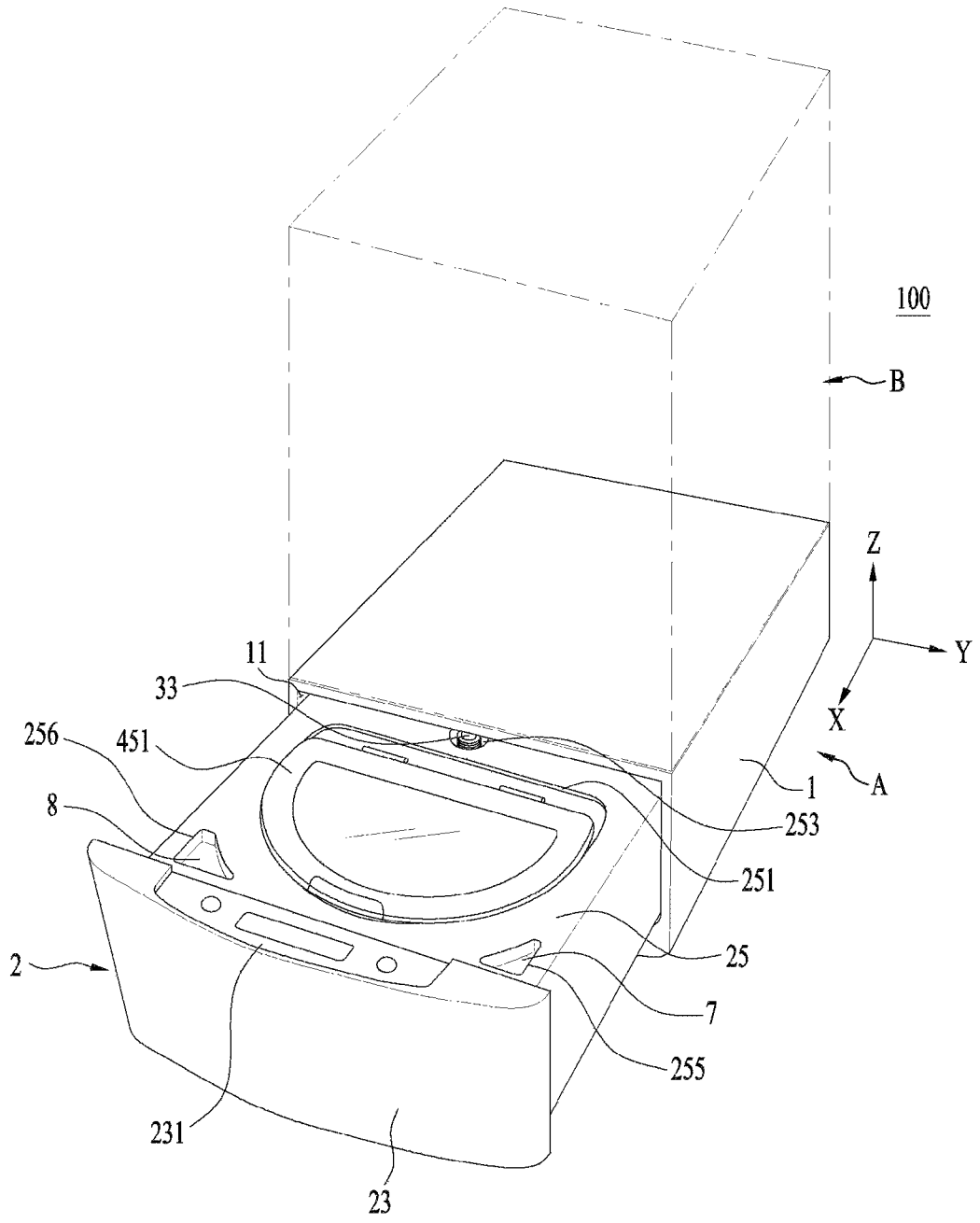

【Fig. 2】
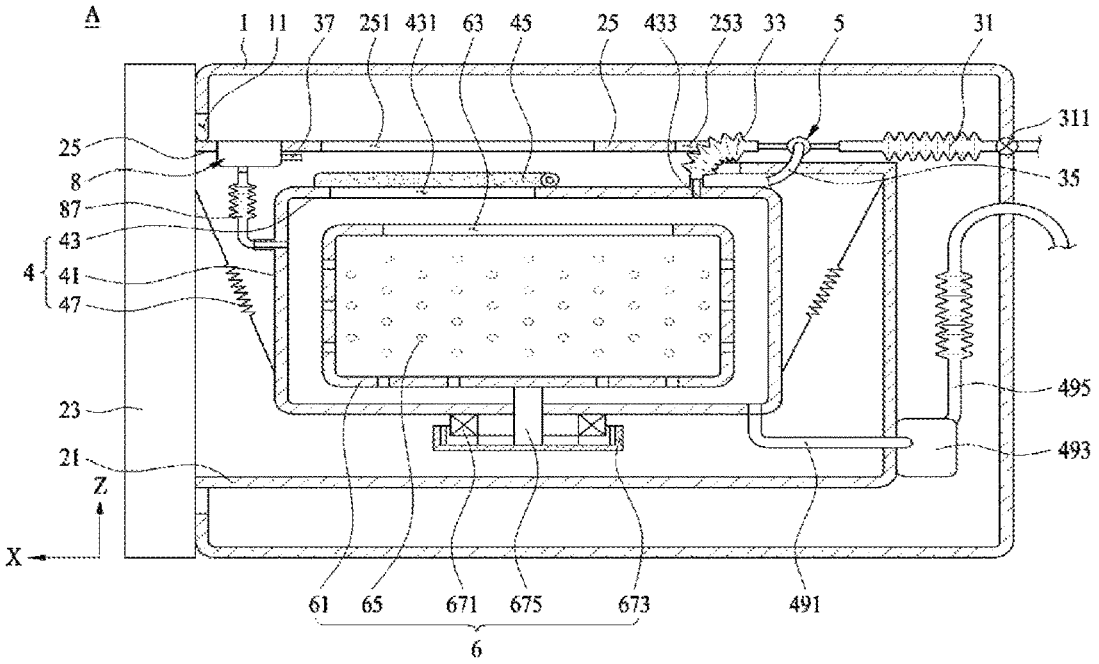
【Fig. 3】
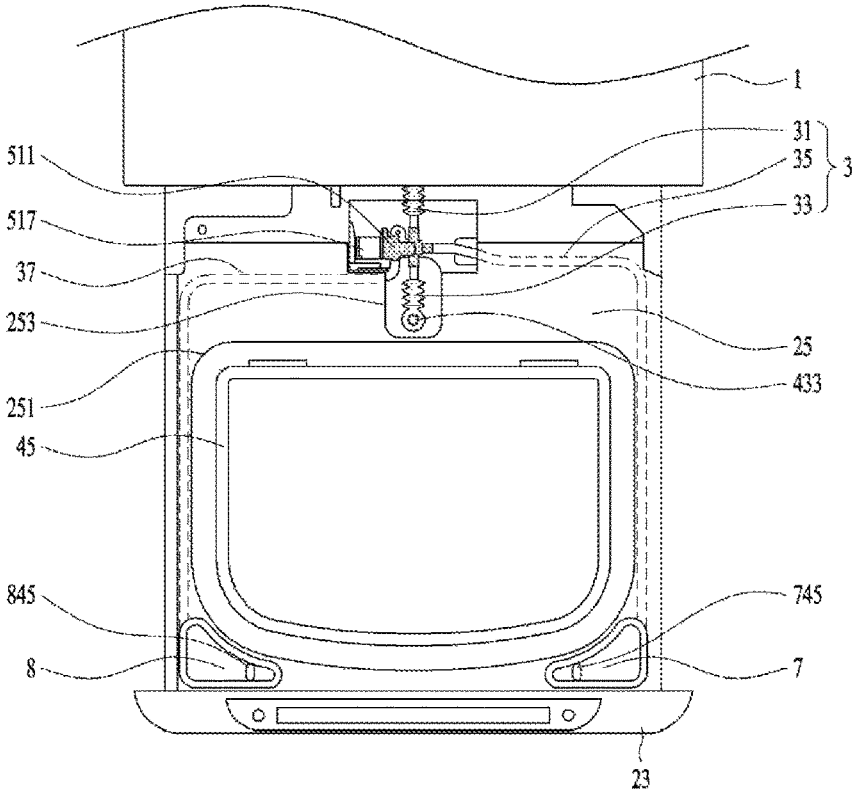

【Fig. 4】
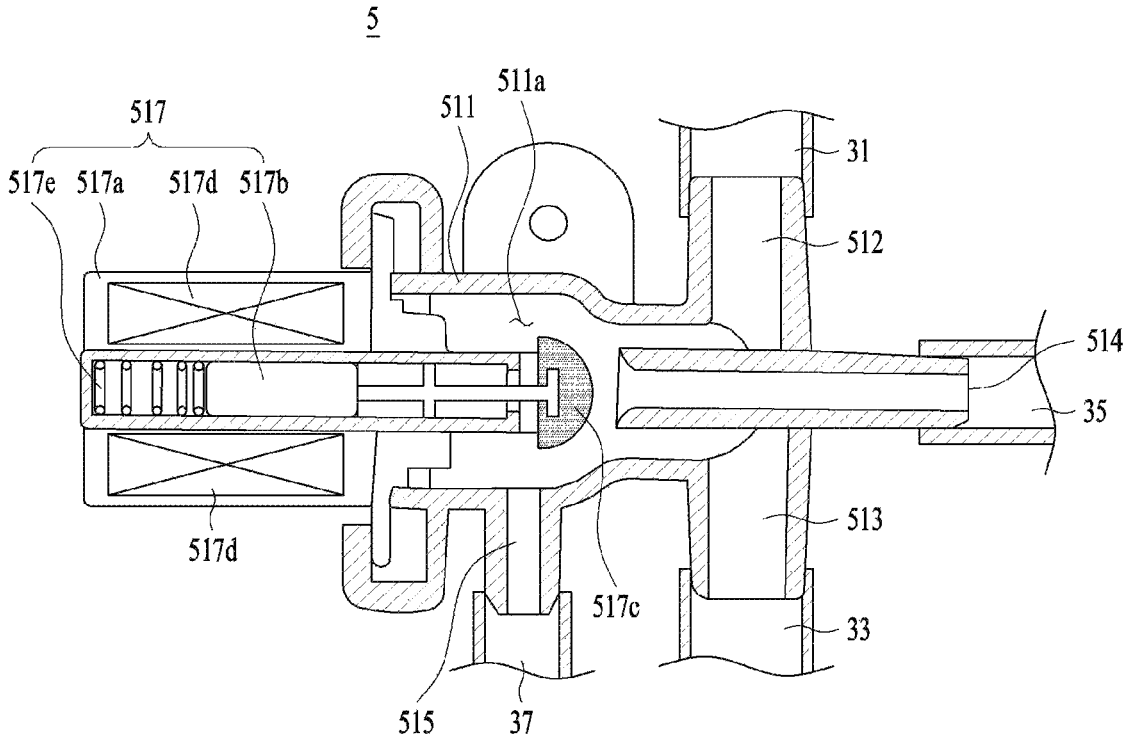

【Fig. 5】
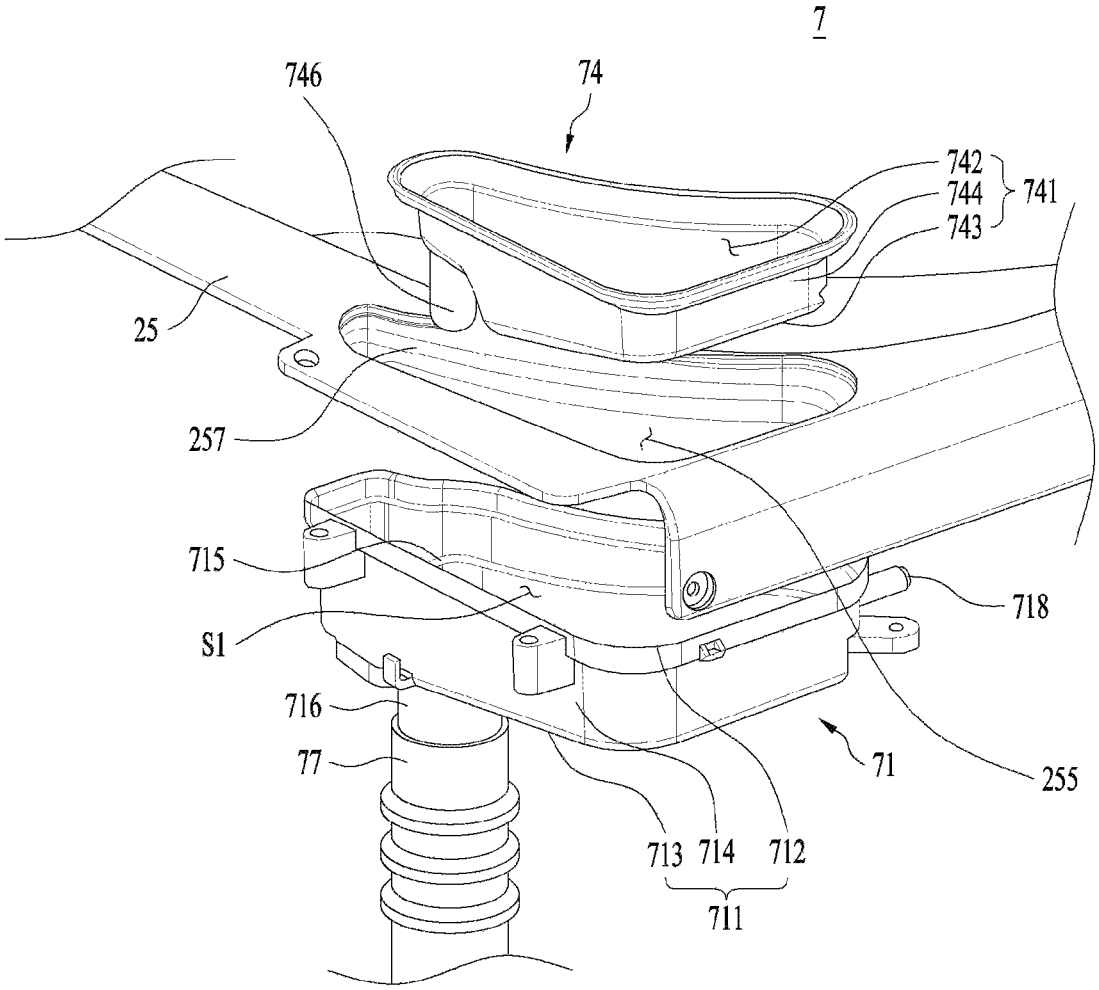

【Fig. 6】
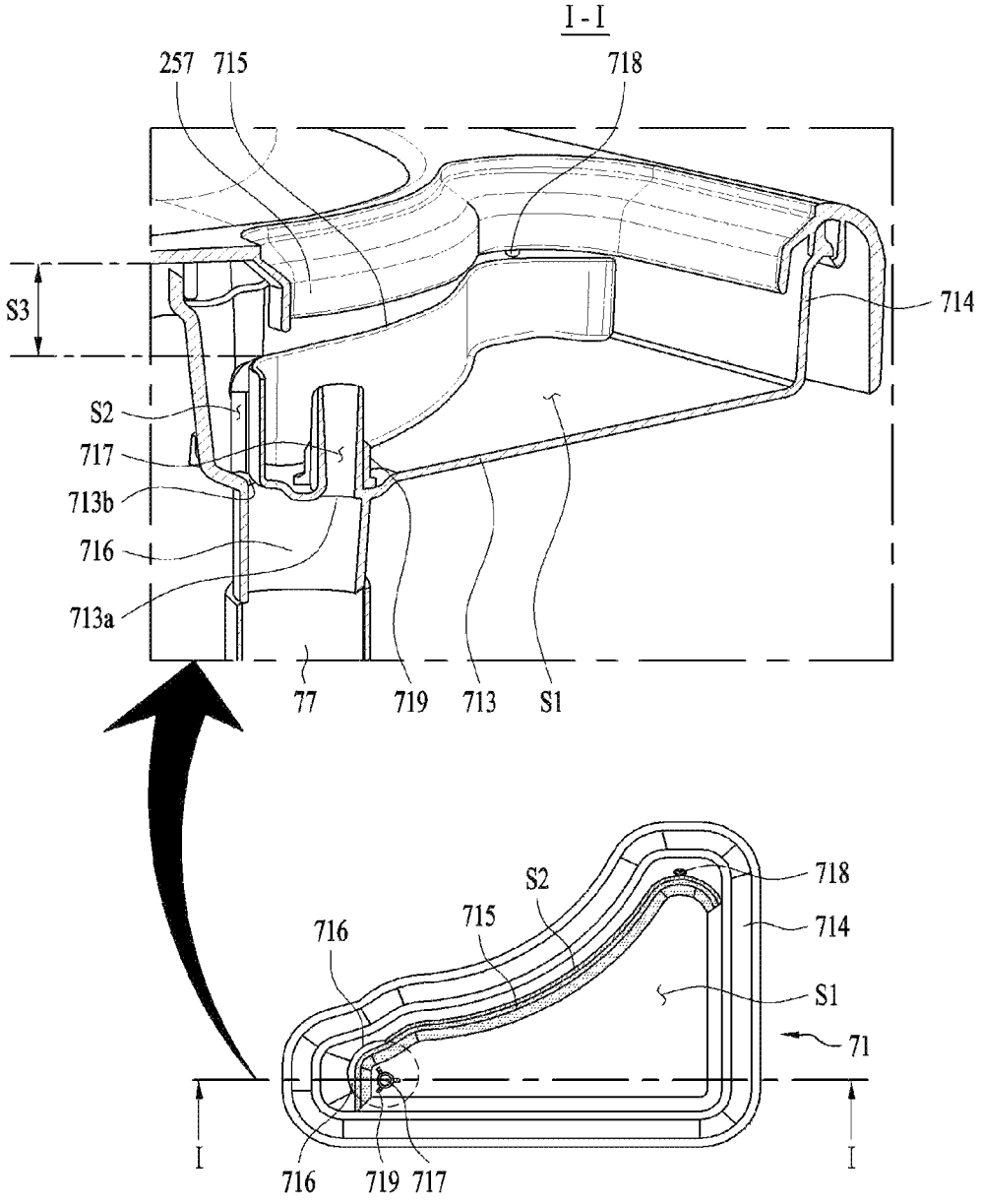

【Fig. 7】
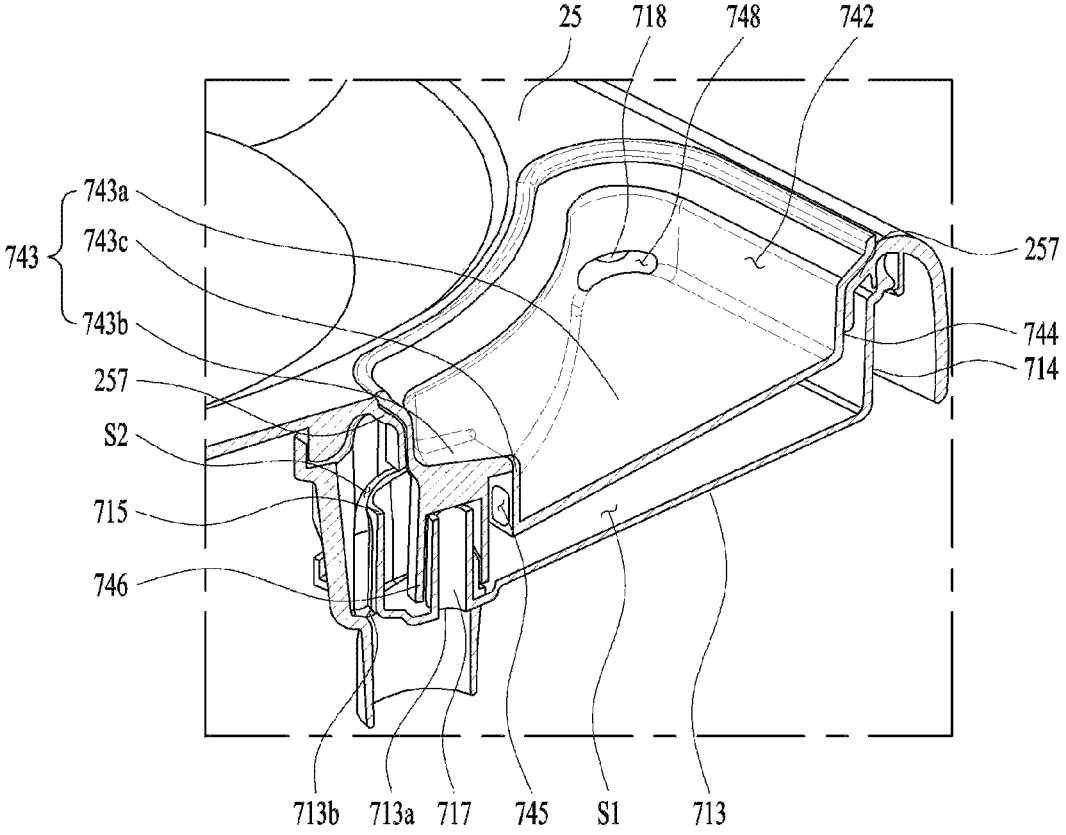

【Fig. 8】
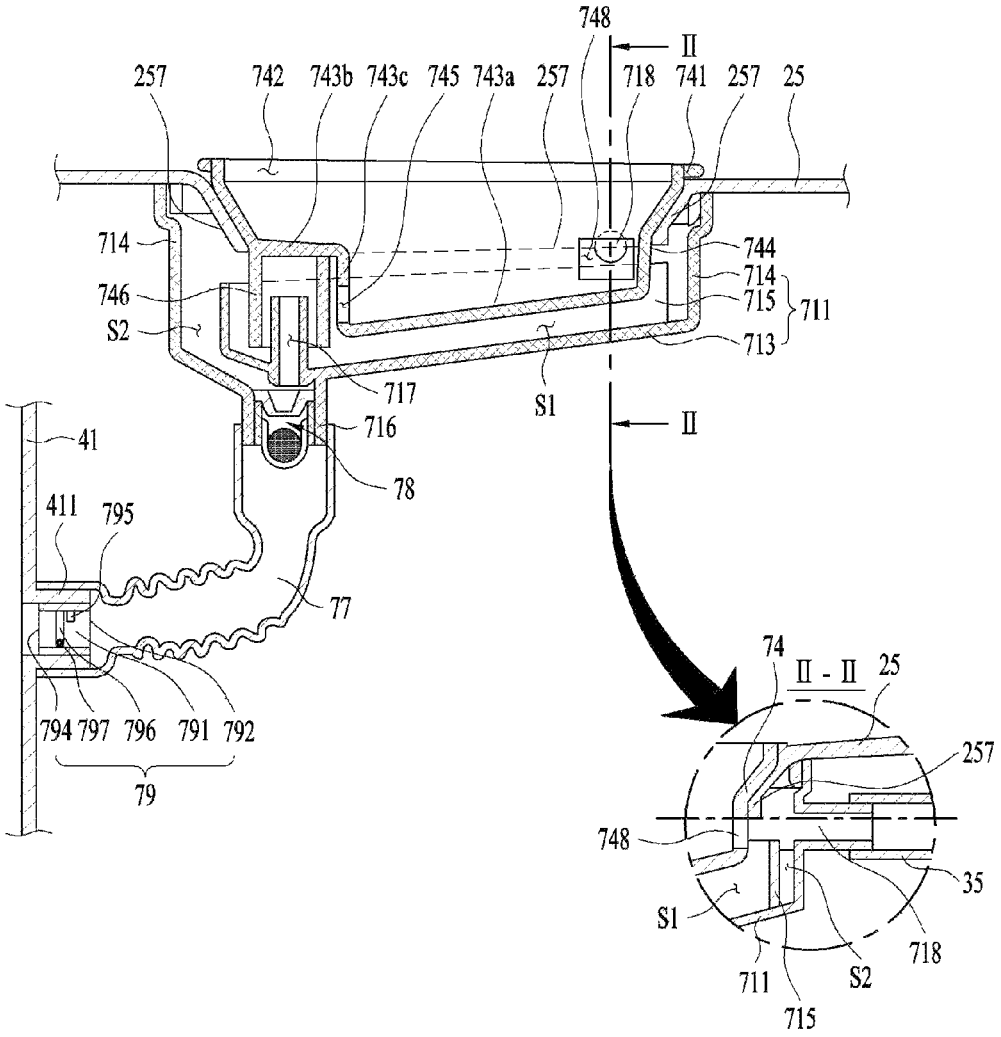

【Fig. 9】
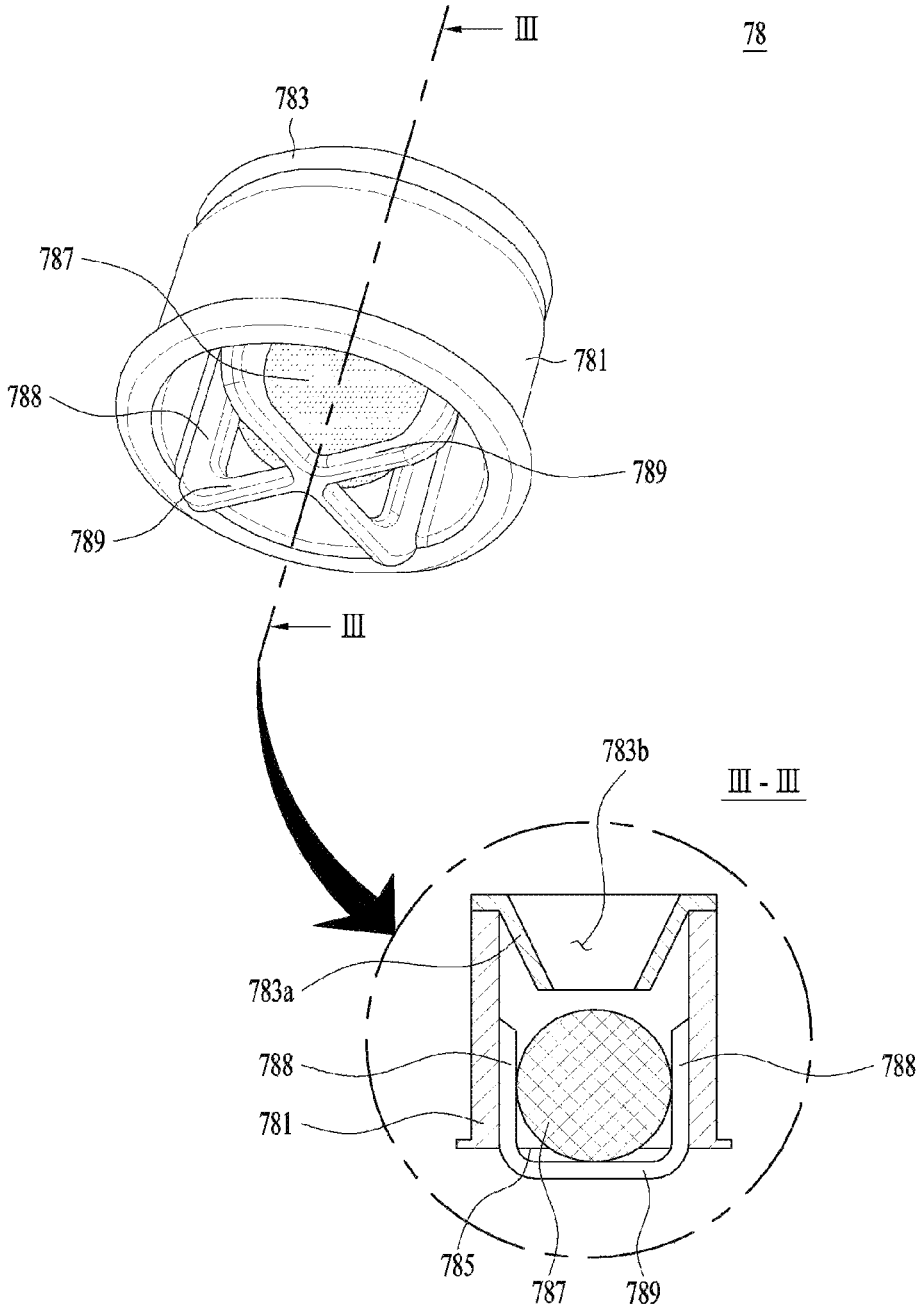

【Fig. 10】
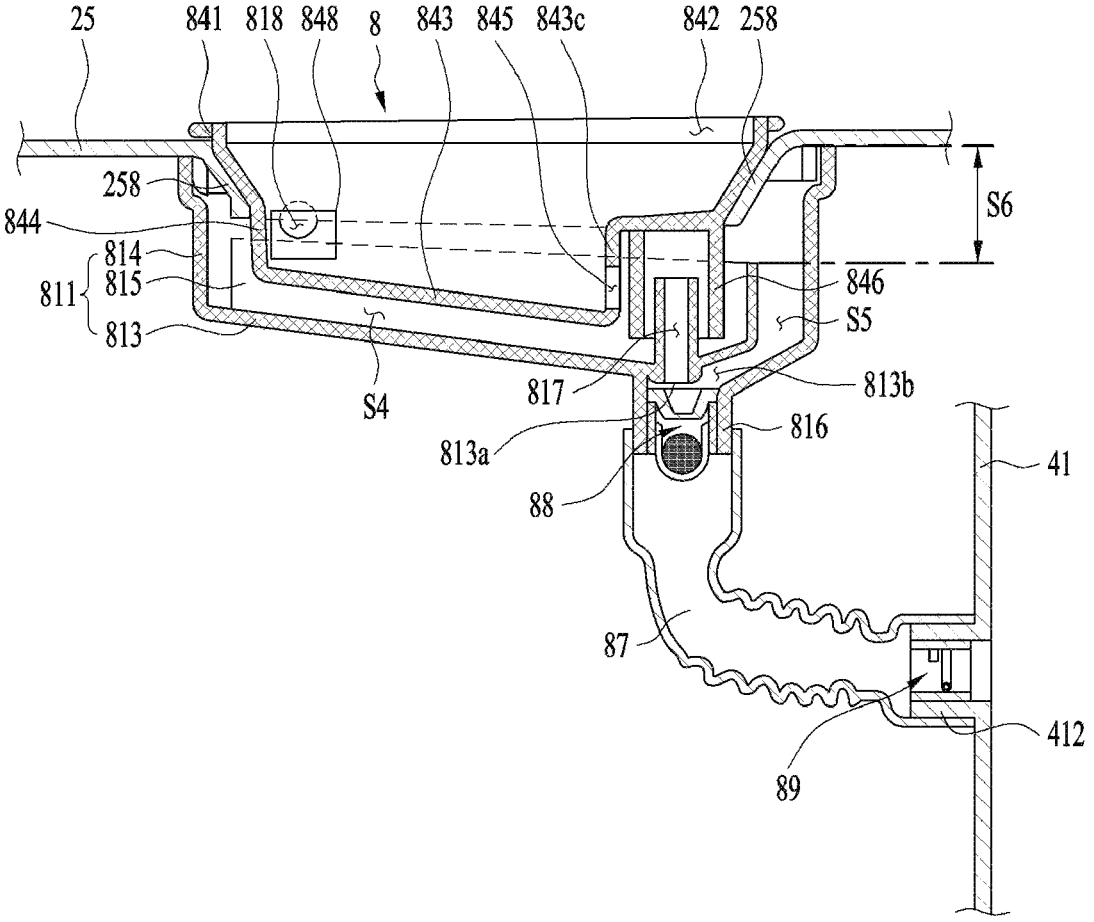

【Fig. 11】
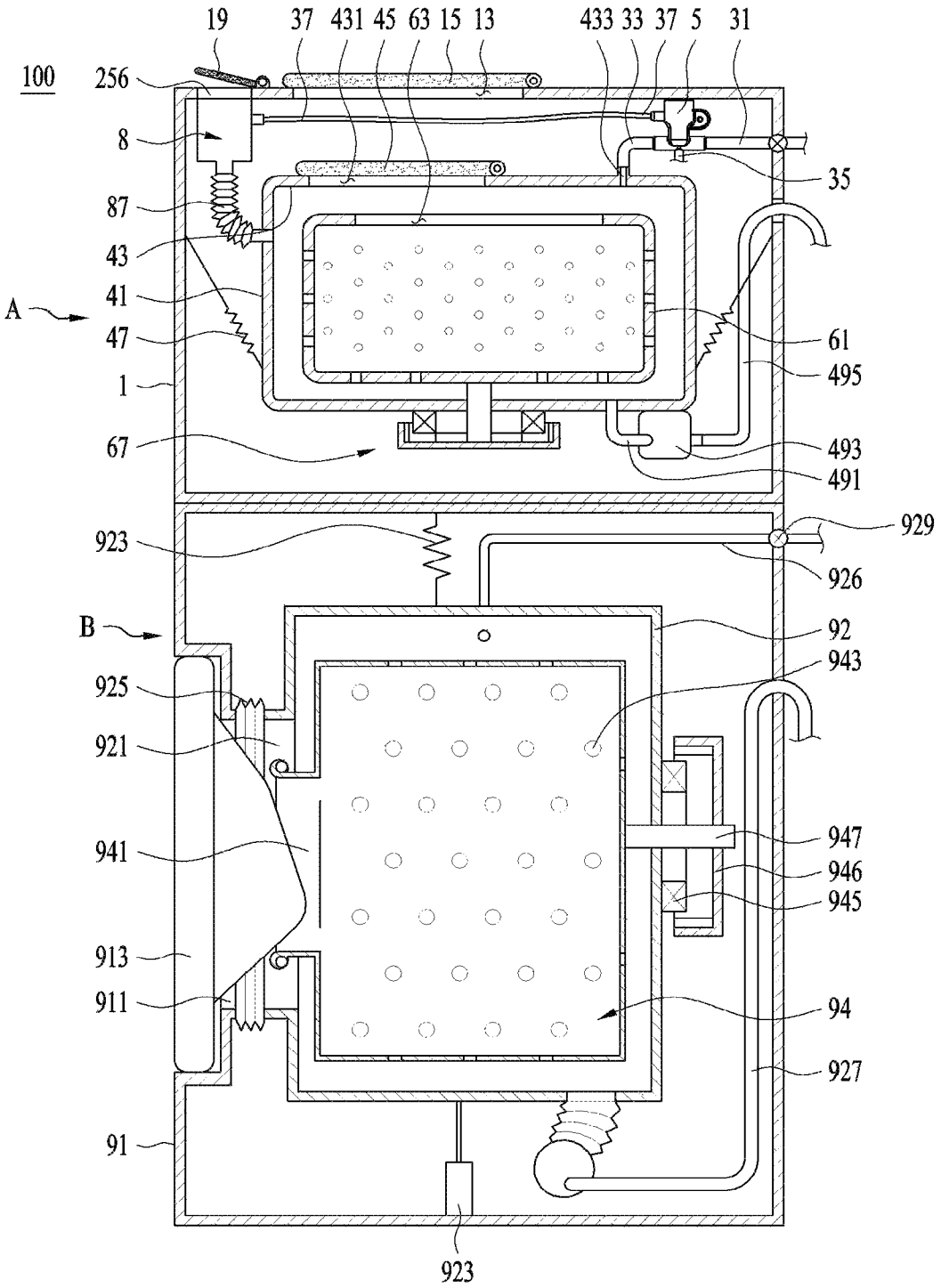

LAUNDRY TREATING APPARATUS

This application claims the benefit of the Korean Patent Application No. 10-2017-0091521, filed on Jul. 19, 2017, which is hereby incorporated by reference as if fully set forth herein.

BACKGROUND OF THE INVENTION

Field of the Invention

The present invention relates to a laundry treating apparatus.

Discussion of the Related Art

Generally, a laundry treating apparatus includes an apparatus for washing laundry (laundry for washing or laundry for drying), an apparatus for drying laundry, and an apparatus for performing both washing and drying laundry.

The laundry treating apparatus of the related art, which can wash laundry, includes a tub in which water is stored, a drum rotatably provided inside the tub to store laundry therein, and a detergent supply unit for supplying a detergent to the tub.

The laundry treating apparatus of the related art includes a storage body for providing a space where a detergent is stored, a storage unit water supply pipe for supplying water to the storage body, and a detergent supply unit that includes a siphon formation portion for moving the detergent and water to a tub by causing siphon if a water level inside the storage body exceeds a preset water level.

However, the detergent supply unit having the aforementioned structure has a problem in that a mixture of the detergent and water is not supplied to the tub if an outlet provided in the siphon formation portion is blocked or the siphon formation portion is damaged.

Also, the laundry treating apparatus which includes the aforementioned detergent supply unit is provided to further include a valve for opening or closing the storage unit water supply pipe. In this case, if the valve for opening or closing the storage unit water supply pipe is out of order, since water supplied from a water supply source is immediately supplied to the storage body, a problem may occur in that the detergent is supplied to the tub at an unwanted timing.

Also, the laundry treating apparatus of the related art needs a means for easily controlling water supply of the tub and water supply of the detergent supply unit.

SUMMARY OF THE INVENTION

Accordingly, the present invention is directed to a laundry treating apparatus that substantially obviates one or more problems due to limitations and disadvantages of the related art.

An object of the present invention is to provide a laundry treating apparatus that includes a connector for controlling water supplied to a tub and water supplied to a detergent supply unit.

Another object of the present invention is to provide a laundry treating apparatus that may supply a detergent stored in a detergent supply unit to a tub even in the case that a means for causing siphon is damaged.

Still another object of the present invention is to provide a laundry treating apparatus that may supply a detergent stored in a detergent supply unit to a tub at a desired timing even in the case that a valve for controlling water supply to the detergent supply unit.

Further still another object of the present invention is to provide a laundry treating apparatus that prevents water stored in a tub from flowing backward to a detergent supply unit through a path that connects the tub with the detergent supply unit.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a laundry treating apparatus comprises a tub for providing a space where water is stored; a drum rotatably provided inside the tub, for storing laundry therein; a detergent supply unit for providing a space where a detergent is stored, provided to supply the detergent to the tub; a connection pipe for connecting the detergent supply unit to the tub; a first water supply pipe connected to a water supply source; a second water supply pipe for guiding water to the tub; a supply unit water supply pipe for guiding water to the detergent supply unit; a housing provided with a chamber; a first path provided in the housing and connected with the first water supply pipe, for allowing the water supplied from the first water supply pipe to enter the chamber; a second path provided in the housing and connected with the second water supply pipe, for guiding the water inside the chamber to the second water supply pipe; a third path provided in the housing and connected with the supply unit water supply pipe, for guiding the water inside the chamber to the supply unit water supply pipe; a first valve provided to open or close the first water supply pipe or provided to open or close the first path; and a second valve provided to open or close the third path.

The laundry treating apparatus of the present invention may further comprise a second tub for providing a space where water is stored, arranged above or below the tub; a second drum rotatably provided inside the second tub, for storing laundry therein; a second tub water supply pipe for guiding the water supplied from the water supply source to the second tub; and a second tub water supply pipe valve for opening or closing the second tub water supply pipe.

The second valve may include a valve housing fixed to the outside of the chamber; a piston of a metal material, which has one end provided to reciprocate inside the valve housing and a free end provided to reciprocate inside the chamber; a sealer fixed to the free end of the piston and provided in a shape for closing the third path; a spring provided inside the valve housing, pressurizing the piston to maintain the state of the third path closed by the sealer; and a coil for opening the third path by moving the piston to be far away from the position of the third path if a current is supplied thereto.

The detergent supply unit includes a cover provided with a detergent inlet; a storage body arranged below the cover, providing a space where the detergent is stored; a barrier for partitioning the inside of the storage body into a first space where the detergent entering through the detergent inlet is stored, and a second space detached from the second space; a storage unit water supply inlet connected to the supply unit water supply pipe, allowing water to enter the first space; a first body through hole provided to pass through a bottom of the storage body, communicating the first space with the connection pipe; a first discharge pipe protruded toward the cover from the first body through hole; a second discharge pipe provided on the bottom of the storage body, communicating the second space with the connection pipe; a siphon formation pipe provided to surround the first discharge pipe, moving a liquid inside the first space to the first body through hole if a water level inside the first space is higher than a height of the first discharge pipe; and a space communication unit provided on the barrier to move the liquid inside the first space to the second space if the liquid is not discharged to the outside of the first space through the first body through hole.

The space communication unit may include a barrier through hole provided to pass through the barrier and provided to be higher than the first discharge pipe and lower than the detergent inlet.

The barrier may be provided to be protruded toward the cover from the bottom of the storage body, and the space communication unit may be provided as a space formed by a free end of the barrier, which is formed to be higher than that of the first discharge pipe and lower than the detergent inlet.

The storage unit water supply inlet may be provided to pass through one surface of the storage body for forming the second space together with the barrier, among the space provided by the storage body, and may be provided to be higher than the free end of the barrier and lower than the detergent inlet.

The laundry treating apparatus of the present invention may further comprise a cabinet having an outlet on a front surface; a drawer body provided to be ejected from the inside of the cabinet to the outside of the cabinet through the outlet, providing a space where the tub is received; a drawer cover forming an upper surface of the drawer body; a tub inlet provided to pass through an upper surface of the tub; a cover through hole provided to pass through an upper surface of the drawer cover and arranged above the tub inlet; a fitting hole provided to pass through the drawer cover, providing a space where the detergent supply unit is provided; and a second cabinet mounted on an upper surface of the cabinet, providing a space where the second tub is received.

The cover may detachably be coupled to the drawer cover through the fitting hole, and the storage body may be fixed to the drawer cover and arranged below the fitting hole.

The cover may include a cover bottom arranged above the storage body; a cover side fixed to the cover bottom to form storage spaces together with the cover bottom and detachably coupled to the fitting hole; and a communication hole provided to pass through the cover bottom or the cover side, discharging the detergent inside the storage spaces to the first space.

The laundry treating apparatus may further comprise a cover water supply inlet provided to pass through the cover side, allowing the water discharged from the storage unit water supply inlet to partially enter the storage spaces.

The laundry treating apparatus may further comprise a guide extended toward the inside of the first space from an edge of the fitting hole to support the cover side, wherein a free end of the guide may be arranged between the cover side and the barrier to attenuate a flow velocity of the water discharged from the storage unit water supply inlet.

The first body through hole may be provided to discharge the liquid inside the first space to the second discharge pipe, and the connection pipe may be provided to connect the second discharge pipe with the tub.

The laundry treating apparatus of the present invention may further comprise a cabinet providing a space where the tub is received; a tub inlet provided to pass through the upper surface of the tub; a cabinet inlet provided to pass through the upper surface of the cabinet and arranged above the tub inlet; a fitting hole provided to the upper surface of the cabinet, providing a space where the cover is provided; and a second cabinet provided to support the bottom of the cabinet, providing a space where the second tub is received.

The laundry treating apparatus of the present invention may further comprise a second detergent supply unit providing a space where the detergent is stored, provided to supply the detergent to the tub through a second connection pipe; a second supply unit water supply pipe connected to the second detergent supply unit; and a fourth path provided in the housing and connected with the second supply unit water supply pipe, guiding the water inside the chamber to the second supply unit water supply pipe.

The first path and the second path may be fixed to the housing to be arranged on one straight line, the fourth path may be fixed to the housing and provided in parallel with the straight line formed by the first path and the second path, and the third path may be fixed to the housing and provided to be orthogonal to the straight line formed by the first path and the second path.

The second detergent supply unit may be provided to store a detergent required for washing of laundry, and the first detergent supply unit may be provided to store a detergent required for rinsing after washing is completed.

According to the present invention, a laundry treating apparatus may be provided, which includes a connector for controlling water supplied to a tub and water supplied to a detergent supply unit.

According to the present invention, a laundry treating apparatus may be provided, which may supply a detergent stored in a detergent supply unit to a tub even in the case that a means for causing siphon is damaged.

Also, according to the present invention, a laundry treating apparatus may be provided, which may supply a detergent stored in a detergent supply unit to a tub at a desired timing even in the case that a valve for controlling water supply to the detergent supply unit.

Also, according to the present invention, a laundry treating apparatus may be provided, which prevents water stored in a tub from flowing backward to a detergent supply unit through a path that connects the tub with the detergent supply unit.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 illustrates an example of a laundry treating apparatus according to the present invention;

FIG. 2 illustrates an example of a first treating apparatus provided in the present invention;

FIGS. 3 and 4 illustrate an example of a water supply unit and a connector, which are provided in the present invention;

FIGS. 5, 6, 7 and 8 illustrate an example of a detergent supply unit provided in the present invention;

FIG. 9 illustrates an example of a first backward flow preventer provided in the present invention;

FIG. 10 illustrates an example of a second detergent supply unit provided in the present invention; and FIG. 11 illustrates another example of a laundry treating apparatus according to the present invention.

DETAILED DESCRIPTION OF THE INVENTION

Reference will now be made in detail to the preferred embodiments of the present invention, examples of which are illustrated in the accompanying drawings. Meanwhile, elements or control method of apparatuses which will be described below are only intended to describe the embodiments of the present invention and are not intended to restrict the scope of the present invention. Wherever possible, the same reference numbers will be used throughout the drawings to refer to the same or like parts.

As shown in FIG. 1, a laundry treating apparatus 100 according to the present invention may include a first treating apparatus A for washing laundry, and a second treating apparatus B arranged on the first treating apparatus to wash or dry laundry. Alternatively, as shown in FIG. 11, the laundry treating apparatus 100 according to the present invention may include a first treating apparatus A for washing laundry, and a second treating apparatus B provided to support a lower surface of the first treating apparatus.

As shown in FIG. 2, the first treating apparatus A may include a cabinet 1, a drawer 2 that may be ejected from the cabinet, a tub 4 provided inside the drawer, for storing water therein, and a drum 6 rotatably provided inside the tub, for storing laundry therein.

The cabinet 1 may be provided as a means for forming an external appearance of the first treating apparatus A, or may be provided as a space (space formed at a wall, etc.) for simply receiving the drawer 2. In any case, it is preferable that an outlet 11 to which the drawer 2 may be inserted is provided on a front surface of the cabinet 1.

The cabinet 1 may be provided to have a width direction (Y-axis direction) of which length is longer than a length of a height direction (Z-axis direction) (A width length of the drawer may be provided to be longer than a length of a height direction).

The drawer 2 may include a drawer body 21 inserted into the cabinet 1 through the outlet 11, a drawer panel 23 fixed to a front surface of the drawer body 21, opening or closing the outlet 11, and a drawer cover 25 for forming an upper surface of the drawer body 21.

If the drawer body 21 is inserted into the cabinet 1, the drawer panel 23 will close the outlet 11, and if the drawer body 21 is ejected from the cabinet 1, the drawer panel 23 will open the outlet 11.

The drawer panel 23 may include a control panel 231 (see FIG. 1) for inputting a control command related to an operation of the laundry treating apparatus 100 and displaying a message related to the operation of the laundry treating apparatus to a user.

The drawer body 21 may be inserted to the cabinet 1 through the inlet 11, and may be provided in all shapes that may provide a space for receiving the tub 4. FIG. 2 illustrates an example of a hexahedral shaped hollow drawer body 21.

The drawer cover 25 includes a first cover through hole 251 and a second cover through hole 253 that communicate the inside of the drawer body 21 with the outside thereof. The first cover through hole 251 should be provided for insertion and ejection of laundry, and the second cover through hole 253 should be provided for supply of water required for washing of laundry. A detailed description of the first and second cover through holes 251 and 253 will be given later.

The tub 4 includes a tub body 41 arranged inside the drawer body 21, in which water is stored, and a tub cover 43 forming an upper surface of the tub body 41. The tub body 41 may be provided in a hollow cylindrical shape. The tub cover 43 may include a tub inlet 431 for communicating the inside of the tub body 41 with the outside of the tub body 41, and a water supply pipe connector 433 for flowing water into the tub body 41.

The tub inlet 431 may be provided below the first cover through hole 251 provided in the drawer cover, and the water supply pipe connector 433 may be provided below the second cover through hole 253.

The tub inlet 431 is a means for inserting laundry into the tub body 41 or ejecting the laundry inside the tub body 41 to the outside of the tub body, and may be opened or closed by a door 45 rotatably coupled to the tub cover 43.

The tub 4 having the aforementioned structure may be fixed to the drawer body 21 through a tub support unit 47. The tub support unit 47 may be provided as a means for attenuating vibration generated in the tub body 41.

The drum 6 provided inside the tub 4 may include a cylindrical shaped drum body 61 provided with a drum inlet 63 provided on an upper surface. Since the drum inlet 63 is arranged below the tub inlet 431, laundry supplied from the outside of the tub through the tub inlet 431 may be supplied to the drum body 61 through the drum inlet 63.

A plurality of drum through holes 65 for communicating the inside of the drum body 61 with the tub body 41 may be provided on a bottom and a circumferential surface of the drum body 61.

The drum body 61 is rotated inside the tub body 41 by a driving unit 67. The driving unit 67 may include a stator 671 fixed to a bottom of the tub body and arranged outside the tub body 41, a rotor 673 rotated by a rotating field provided by the stator, and a rotary shaft 675 provided to pass through the bottom of the tub body 41, connecting the bottom of the drum body with the rotor.

In this case, the rotary shaft 675 may be provided to be orthogonal to the bottom of the tub body 41, and the drum inlet 63 may be provided to be parallel with the ground. The expression that the rotary shaft 675 is to be orthogonal to the bottom of the tub body 41 means that an angle between the rotary shaft and the bottom of the tub body is 90° within an error range (tolerance required during design or assembly).

The first treating apparatus A having the aforementioned structure discharges the water stored in the tub 4 to the outside of the cabinet 1 through a drainage unit. The drainage unit may include a drainage pump 493 fixed to the drawer body 21, a first tub drainage pipe 491 for guiding the water inside the tub body 41 to the drainage pump 493, and a second tub drainage pipe 495 for guiding the water discharged from the drainage pump 493 to the outside of the cabinet 1. In this case, the second tub drainage pipe 495 may be provided as a corrugated pipe (pipe provided as an elastic material along a length direction or elastic pipe in a length direction).

The first treating apparatus A further includes a means for supplying a detergent to the tub body 41. This detergent supply means for supplying a detergent to the first treating apparatus may include a detergent supply unit 7 only, or may include the detergent supply unit 7 (first detergent supply unit) and a second detergent supply unit 8. FIG. 3 illustrates that the detergent supply means includes a first detergent supply unit 7 and a second detergent supply unit 8 as an example.

The detergent supplied to the tub body through the detergent supply unit includes a washing detergent supplied to laundry during a washing course to remove particles from the laundry, a rinsing detergent supplied to the laundry during a rinsing course of the laundry to soften the laundry, and a material, such as a bleaching agent, supplied to the laundry to make the laundry white.

If the detergent supply means includes the first detergent supply unit 7 and the second detergent supply unit 8, the water supply unit 3 provided in the first treating apparatus A may include a first water supply pipe 31 connected with a water supply source, a second water supply pipe 33 for guiding water to the tub body 41, a supply unit water supply pipe 35 (first supply unit water supply pipe) for guiding water to the detergent supply unit 7 (first detergent supply unit), and a second supply unit water supply pipe 37 for guiding water to the second detergent supply unit 8. However, unlike the shown drawing, if the detergent supply means includes the first detergent supply unit 7 only, the water supply unit 3 may include the first water supply pipe 31, the second supply unit water supply pipe 33, and the supply unit water supply pipe 35.

The first water supply pipe, the second water supply pipe, the first supply unit water supply pipe 35 and the second supply unit water supply pipe 37 are connected to one another through a connector 5. As shown in FIG. 4, the connector 5 may include a housing 511 provided with a chamber 511*a* for forming a space where water is stored, a first path 512 provided in the housing and connected with the first water supply pipe 31, a second path 513 provided in the housing and connected with the second water supply pipe 33, a third path 514 provided in the housing and connected with the first supply unit water supply pipe 35, and a fourth path 515 provided in the housing and connected with the second supply unit water supply pipe 37.

The first water supply pipe 31 may be provided as a corrugated pipe of which one end is fixed to the water supply source and the other end is fixed to the first path 512. The first water supply pipe 31 is provided to be opened or closed by a first valve 311 (see FIG. 2) provided to be operated under the control of a controller. Therefore, if the first valve 311 opens the first water supply pipe 31, the water supplied from the water supply source will be supplied to the chamber 511*a* through the first path 512. Unlike the aforementioned description, the first valve 311 may be provided in the connector 5 to open or close the first path 512.

Since the second water supply pipe 33 is provided to connect the second path 513 with the water supply pipe connector 433 provided in the tub cover, the water stored in the chamber 511*a* will be supplied to the tub body 41 through the second path 513 and the second water supply pipe 33.

One end of the first supply unit water supply pipe 35 is fixed to the third path 513 and its other end is connected to the first detergent supply unit 7. The third path 514 is opened or closed by a second valve 517 operated under the control of the controller. Therefore, if the second valve 517 opens the third path 514, the water in the chamber 511*a* will be supplied to the first detergent supply unit 7 through the third path and the first supply unit water supply pipe 35.

The second valve 517 may include a valve housing 517*a* fixed to the outside of the chamber 511*a*, a piston 517*b* of a metal material, which has one end provided to reciprocate inside the valve housing 517*a* and a free end provided to reciprocate inside the chamber 511*a*, a sealer 517*c* provided in a shape for closing the third path 514 and fixed to the free end of the piston, a spring 517*e* pressurizing the piston 517*b* to allow the sealer 517*c* to maintain the closing state of the third path 514, and a coil 517*d* for detaching the sealer 517*c* from the third path 514 by moving the piston 517*e* if a current is supplied. The spring 517*e* may be provided in the valve housing 517*a* to pressurize the piston 517*b* toward the third path 514.

Meanwhile, one end of the second supply unit water supply pipe 37 is fixed to the fourth path 515 and its other end is connected to the second detergent supply unit 8. If a separate valve is not provided in the fourth path 515, the second detergent supply unit 8 will always be supplied with the water when the first valve 311 opens the first water supply pipe 31. On the other hand, if a separate valve (the third valve) for opening or closing the fourth path 515 is further provided, the second detergent supply unit 8 will be supplied with the water when the first valve and the third valve open the first water supply pipe 31 and the fourth path.

As shown in FIG. 5, the first detergent supply unit 7 (detergent supply unit) may be fixed to the drawer 2 through a fitting hole 255 (the first fitting hole) provided to pass through the drawer cover 25. That is, the first detergent supply unit 7 may include a storage unit 71 (the first storage unit) fixed to the drawer cover 25 to be arranged below the fitting hole 255, a cover 74 (the first cover) arranged above the storage unit 71 by being supported in the fitting hole 255 or fixed to the storage unit 71 by being inserted to the fitting hole 255, and a connection pipe 77 (the first connection pipe) for connecting the storage unit 71 with the tub body 41.

The storage unit 71 may be provided as a storage body 711 (the first storage body) for providing a space where a detergent is stored. The storage body 711 may be provided in all shapes that may provide a space for storing the detergent. In FIG. 5, the storage body 711 may include a body upper surface 712 (the first body upper surface) provided with an opened surface, a body bottom 713 (the first body bottom) arranged below the fitting hole 255, and a body side 714 (the first body side) provided along an edge of the body bottom, forming a space for storing the detergent, together with the body bottom 713.

The body upper surface 712 may surround an edge of the fitting hole 255, and may be provided in all shapes that may communicate the inside of the storage body 711 with the outside of the drawer cover through the fitting hole 255.

As shown in FIG. 6, the storage unit 71 may further include a barrier 715 (the first barrier) for partitioning an inner space of the storage body 711 into a first space S1 (the first body first space) where the detergent is stored, and a second space S2 (the first body second space) detached from the first space, forming a path. The barrier 715 may be provided as a board extended from the body bottom 713 to the cover 74.

The first space S1 may be provided to be communicated with the tub body 41 through a first body through hole 713*a* (the first body first through hole) passing through the body bottom 713, and the second space S2 may be provided to be communicated with the tub body 41 through a second body through hole 713*b* (the first body second through hole) passing through the body bottom 713.

A first discharge pipe 717 (the first body first discharge pipe) is connected to the first body through hole 713*a*, and a second discharge pipe 716 (the first body second discharge pipe) is connected to the second body through hole 713*b*. The first discharge pipe 717 is a pipe protruded toward the body upper surface from the body bottom 713, and a liquid inside the first space S1 moves to the first body through hole 713*a* through the first discharge pipe 717.

One end of the connection pipe 77 may be fixed to the second discharge pipe 716. In this case, the first body through hole 713*a* may be provided to communicate the first space S1 with the second discharge pipe 716. Although not shown, the first body through hole 713*a* may be provided to directly supply the liquid (mixture of detergent and water), which is discharged from the first space S1, to the connection pipe 77 without passing through the second discharge pipe 716.

The first space S1 is supplied with water through a storage unit water supply inlet 718 (the first storage water supply inlet) provided to pass through the body side 714, wherein the storage unit water supply inlet 718 is connected to the water supply source through the first supply unit water supply pipe 35.

As shown in FIG. 7, the cover 74 (the first cover) may be provided as a cover body 741 (the first cover body) inserted to the fitting hole 255. The cover body 741 includes a cover bottom 743 (the first cover bottom) arranged above the storage body 711, a cover side 744 (the first cover side) fixed to the cover bottom, forming storage spaces together with the cover bottom, and a detergent inlet 742 (the first detergent inlet) provided on the cover body, allowing the detergent to enter the storage spaces 743 and 744.

The fitting hole 255 may further include a guide 257 (the first guide) to allow the cover body 741 to be easily coupled to the fitting hole 255. The guide 257 may be provided as a board extended toward the inside of the first space S1 from the edge of the fitting hole 255. In this case, the cover side 744 may be provided in a shape that may be mounted on the guide 257. That is, the cover side 744 may be supported in the guide 257 and detachably be coupled to the fitting hole 255.

The guide 257 may be provided as an inclined surface protruded toward the center of the fitting hole 255 from the edge of the fitting hole 255 and downwardly inclined toward the center of the fitting hole 255.

The storage spaces formed by the cover bottom 743 and the cover side 744 are communicated with the first space S1 through a communication hole 745 (the first communication hole). Therefore, the detergent entering the storage spaces 743 and 744 of the cover body 741 through the detergent inlet 742 is moved to the first space S1 through the communication hole 745. To allow the detergent supplied to the spaces 743 and 744 to easily enter the first space S1, the cover bottom 743 may be provided to be downwardly inclined toward the communication hole 745.

The detergent inlet 742 may be provided as an opened surface formed on an upper surface of the cover body 741, or may be provided as a hole provided to pass through the upper surface of the cover body 741.

The first detergent supply unit 7 further includes a siphon formation pipe 746 (the first siphon formation pipe) for forming a siphon guider together with the first discharge pipe 717 provided in the storage body 711. The siphon formation pipe 746 is a means provided to surround the first discharge pipe 717, moving a liquid (mixture of detergent and water) inside the first space S1 to the first body through hole 713*a* if a water level inside the first space S1 is higher than a height of the first discharge pipe 717. FIG. 8 illustrates that the siphon formation pipe 746 is provided as a pipe protruded toward the body bottom 713 from the cover bottom 743 as an example.

In this case, the cover bottom 743 may include a first bottom 745*a*, a second bottom 743*b* provided to be higher than the first bottom, providing a space to which the siphon formation pipe 746 is fixed, and a connection surface 743*c* connecting the first bottom with the second bottom, provided with the communication hole 745. Preferably, the first bottom 743*a* is provided to be downwardly inclined toward the communication hole 745, and the second bottom 743*b* is provided to be downwardly inclined toward an upper end of the connection surface 743*c*.

The storage body 711 includes a spacer 719 which is a means for maintaining an interval between an inner circumferential surface of the siphon formation pipe 746 and an outer circumferential surface of the first discharge pipe 717 and an interval between a lower end of the siphon formation pipe 746 and the body bottom 713.

Meanwhile, a problem may occur in that the first detergent supply unit 7 having the aforementioned structure only fails to supply the detergent stored in the first space S1 to the tub 4 if the siphon guider is damaged (if the first body through hole is blocked, the siphon formation pipe is damaged, etc.). That is, if water is supplied to the first space S1, a risk occurs in that the detergent stored in the first space S1 may leak into the cabinet 1 together with the water through the communication hole 745 and the detergent inlet 742.

To solve the problem, the first detergent supply unit 7 includes a space communication unit (the first space communication unit) provided on the barrier 715, communicating the first space S1 with the second space S2.

As shown in FIG. 6, the space communication unit may be provided as a space S3 formed as a free end of the barrier 715 is higher than that of the first discharge pipe 717 and is lower than the detergent inlet 742.

If the barrier 715 is provided as a board extended toward the cover 74 from the body bottom 713 so that an upper end of the barrier 713 is in contact with the cover 74, the space communication unit may be provided as a barrier through hole provided to pass through the barrier 715. In this case, the barrier through hole should be provided to be higher than the free end of the first discharge pipe 717 and lower than the detergent inlet 742.

It is supposed that the aforementioned space communication unit S3 is provided in the barrier 715. In this case, if the liquid inside the first space S1 is not discharged to the outside of the first space S1 through the first body through hole 713*a*, the liquid inside the first space S1 is moved to the second space S2, and the liquid moved to the second space S2 will be supplied to the tub body 41 through the second body through hole 713*b* and the second discharge pipe 716. Therefore, the detergent supply unit provided in the present invention may supply the detergent to the tub body even though the siphon guider is damaged.

Meanwhile, since the first detergent supply unit 7 provided in the present invention has a structure that the detergent is stored in the first space S1 by being supplied to the communication hole 745 along the cover bottom 743, the detergent may remain in the cover bottom 743. If the detergent remains in the cover bottom 743, a sanitary problem may be caused. To solve the problem, the first detergent supply unit 7 may further include a cover water supply inlet 748 (the first cover water supply inlet) for preventing the detergent from remaining in the cover bottom 743.

As shown in FIG. 8, the cover water supply inlet 748 is a means provided to pass through the cover side 744, allowing the water supplied from the storage unit water supply inlet 718 to partially enter the storage spaces formed by the cover bottom 743 and the cover side 744. Therefore, the water supplied to the first space S1 through the storage unit water supply inlet 718 partially enters the cover body 741 through the cover water supply inlet 748, and the water entering the cover body 741 will be supplied to the first space S1 through the communication hole 745 after washing the cover bottom 743. Therefore, in the present invention, the problem that the detergent remains in the cover body may be minimized.

Meanwhile, a water pressure of water supplied from the water supply source may be varied depending on zones where the laundry treating apparatus is provided. If a water pressure of the zone where the laundry treating apparatus is provided is high, a pressure of water supplied to the first space S1 through the storage unit water supply inlet 718 will be high. Therefore, a problem may occur in that the water supplied to the first space S1 through the storage unit water supply inlet 718 may detach the cover 74 from the fitting hole 255 or discharge the detergent stored in the first space S1 to the outside of the first detergent supply unit 7.

To solve the problem, a free end of the guide 257 may be provided to be arranged between the cover side 744 and the barrier 715, thereby attenuating a flow velocity of the water supplied from the storage unit water supply inlet 718. That is, as shown in FIG. 8, the guide 257 may be extended toward the first space S1 from the fitting hole 255 to close a partial area of the storage unit water supply inlet 718 if the guider is projected in the cover side 744.

The first detergent supply unit 7 having the aforementioned structure supplies the detergent to the tub body 41 through the connection pipe 77 as described above, and a diameter of each bottom of the drum body 61 and the tub body 41 provided in the present invention is set to be longer than its height, whereby a problem may occur in that the water inside the tub body may backward flow toward the first detergent supply unit 7 through the connection pipe 77 when the drum body 61 is rotated. To solve this problem, the present invention may further include a first backward flow preventer 78 and a second backward flow preventer 79.

One end of the connection pipe 77 may be fixed to the second discharge pipe 716 and its other end may be fixed to a detergent inlet pipe 411 (the first detergent inlet pipe) provided to pass through the circumferential surface of the tub body 41. In this case, it is preferable that the first backward flow preventer 78 is fixed to the second discharge pipe 716 and the second backward flow preventer 79 is fixed to the detergent inlet pipe 411. This facilitates assembly of the backward flow preventers 78 and 79.

That is, if the backward flow preventers 78 and 79 are respectively provided in the second discharge pipe 716 and the detergent inlet pipe 411, they may be assembled more easily than the case that at least one of the backward flow preventers is provided inside the connection pipe 77.

As shown in FIG. 9, the first backward flow preventer 78 (the first storage unit first backward flow preventer) may include a first communication pipe 781 inserted and fixed to the second discharge pipe 716, a sealing unit 783 for allowing the liquid (mixture of detergent and water) to enter the first communication pipe 781, a first communication pipe discharge outlet 785 for discharging the liquid inside the first communication pipe 781 to the connection pipe 77, a ball 787 reciprocating inside the first communication pipe 781, and a support unit 789 provided in the first communication pipe discharge outlet 785 to allow the ball 787 to be mounted thereon.

The first communication pipe 781 may be provided in a cylindrical shape in which both surfaces (upper surface and lower surface) facing each other are opened. In this case, the first communication pipe discharge outlet 785 may be an opened surface of the first communication pipe 781.

The sealing unit 783 may include a sealing body 783*a* coupled to the opened upper surface of the first communication pipe 781, and a first communication pipe inlet 783*b* provided to pass through the sealing body 783*a*. It is preferable that the sealing body 783*a* is provided as an elastic body such as rubber. A path formation portion 788 for forming a path between the ball 787 and the inner circumferential surface of the first communication pipe 781 is provided on the inner circumferential surface of the first communication pipe 781.

Therefore, if the water inside the tub body 41 enters the first communication pipe 781 through the connection pipe 77 and the first communication pipe discharge outlet 785 in accordance with rotation of the drum body 61, the ball 787 prevents the water inside the tub body 41 from being supplied to the first detergent supply unit 7 by closing the first communication pipe inlet 783*b*.

However, if the water inside the tub body 41 does not backward flow to the first communication pipe 781 through the first communication pipe discharge outlet 785, the ball 787 maintains the state that it is mounted on the support unit 789, by means of self-load. If the ball 787 maintains the state that it is mounted on the support unit 789, a path is formed between the first communication pipe 781 and the ball 787 by the path formation portion. Therefore, in this state, if the water is supplied to the first space S1, the detergent will be supplied to the tub body 41 through the first discharge pipe 717, the first communication pipe inlet 783*b* and the connection pipe 77.

As shown in FIG. 8, the second backward flow preventer 79 (the first storage unit second backward flow preventer) may include a second communication pipe 791 inserted and fixed to the detergent inlet pipe 411, a second communication pipe inlet 793 for allowing the liquid to enter the second communication pipe 791, a second communication pipe discharge outlet 794 for discharging the liquid entering the second communication pipe 791 to the detergent inlet pipe 411, and a blocking board 796 provided inside the second communication pipe 791 to block entrance of the liquid inside the tub body 41 to the connection pipe 77 and allowing the liquid inside the connection pipe 77 to enter the tub body 41.

The second communication pipe 791 may also be provided in a cylindrical shape in which both surfaces (upper surface and lower surface) facing each other are opened. The blocking board 796 may rotatably be fixed into the second communication pipe 791 through a shaft 797. Also, the second communication pipe 791 may include a stopper 795 for supporting the blocking board 796 to prevent the blocking board 796 from being rotated to be far away from the tub body 41.

In the laundry treating apparatus 100 having the aforementioned structure only, a leakage may occur in that a small amount of water may enter the supply unit water supply pipe 35 when the first valve 311 opens the first supply pipe 31 in a state that the second valve 517 is damaged (wear of sealer). If the leakage occurs in the supply unit water supply pipe 35, a problem may occur in that the detergent stored in the first detergent storage unit 7 is not supplied to the tub 4 at a desired timing.

To solve the problem, as shown in FIG. 8, the storage unit water supply inlet 718 provided in the first detergent supply unit 7 is preferably provided to pass through one surface of the storage body 711 for forming the second space S2 together with the barrier 715 among the space provided by the storage body 711. Also, the storage unit water supply inlet 718 is preferably provided to be higher than the free end of the barrier 715 and lower than the detergent inlet 742 so that the water supplied from the storage unit water supply inlet 718 may be supplied to the first space S1 by passing through the free end of the barrier 715.

The water supplied from the storage unit water supply inlet 718 is supplied to the first space S1 by passing through the free end of the barrier 715 to allow the water discharged from the storage unit water supply inlet 718 to enter the second space S2 if the pressure of the water discharged from the storage unit water supply inlet 718 is low.

Therefore, the first detergent supply unit 7 provided in the present invention may prevent the detergent stored therein from being supplied to the tub at an unwanted timing even though the small amount of water leaks into the supply unit water supply pipe 35 due to a minor damage of the second valve 517.

Moreover, the free end of the barrier 715 may be provided to be downwardly inclined toward a direction that the second body through hole 713*b* is arranged from a direction that the storage unit water supply inlet 718 is arranged. This is to prevent the water from remaining in the second space S2.

FIG. 10 illustrates an example of the second detergent supply unit 8. The second detergent supply unit 8 provided in the present invention may be provided to have the same structure as that of the first detergent supply unit 7. That is, the second detergent supply unit 8 may include a second cover 84 detachably coupled to a second fitting hole 256 (see FIG. 1) provided to pass through the drawer cover, a second storage unit 81 fixed to the drawer cover 25 and arranged below the second fitting hole 256, and a second connection pipe 87 for guiding the detergent stored in the second storage unit to the tub body 41.

The second storage unit 81 may be provided as a second storage body 811 for providing a space where the detergent is stored. The second storage body 811 may include a second body bottom 813 arranged below the second fitting hole 256, and a second body side 814 provided along an edge of the second body bottom 813, forming a space for storing the detergent, together with the second body bottom 813.

The second storage unit 81 may further include a second barrier 815 for partitioning an inner space of the second storage body 811 into a second storage unit first space S4 where the detergent is stored, and a second storage unit second space S5 detached from the second storage unit first space, forming a path. The second barrier 815 may include a second space communication unit S6. Since a function of the second space communication unit S6 is the same as that of the space communication unit S3 (the first space communication unit), its detailed description will be omitted.

The second storage unit first space S4 may be provided to be communicated with the tub body 41 through a second body first through hole 813*a* passing through the second body bottom 813, and the second storage unit second space S5 may be provided to be communicated with the tub body 41 through a second body second through hole 813*b* passing through the second body bottom 813.

A second body first discharge pipe 817 is connected to the second body first through hole 813*a*, and a second body second discharge pipe 816 is connected to the second body second through hole 813*b*. One end of the second connection pipe 87 may be fixed to the second body second discharge pipe 816. In this case, the second body first through hole 813*a* may be provided to communicate the second storage unit first space S4 with the second body second discharge pipe 816.

The second storage unit first space S4 is supplied with water through a second storage unit water supply inlet 818 provided to pass through the second body side 814, wherein the second storage unit water supply inlet 818 is connected to the water supply source through the second supply unit water supply pipe 37. The second storage unit water supply inlet 818 is preferably provided to pass through one surface of the second storage body 811 for forming the second storage unit second space S5 together with the second barrier 815 among the space provided by the second storage body 711, thereby implementing the same effect as that of the storage unit water supply inlet 718 of the first detergent supply unit. Therefore, the second storage unit water supply inlet 818 is preferably arranged to be higher than the free end of the second barrier 815 and lower than the second detergent inlet 842.

The second cover 84 may be provided as a second cover body 841 inserted to the second fitting hole 256. The second cover body 841 includes a second cover bottom 843 arranged above the second storage body 811, a second cover side 844 fixed to the second cover bottom, forming second storage space together with the second cover bottom, and a second detergent inlet 842 provided on the second cover body, allowing the detergent to enter the second storage spaces 843 and 844.

The second fitting hole 256 may further include a second guide 258 to allow the second cover body 841 to be easily coupled to the second fitting hole 256. The second guide 258 may be provided as a board extended toward the inside of the second storage unit first space S4 from the edge of the second fitting hole 256. In this case, the second cover side 844 may be supported in the second guide 258 and detachably be coupled to the second fitting hole 256. Since a shape and function of the second guide 258 are the same as those of the first guide 257 of the first detergent supply unit 7, their detailed description will be omitted.

The second storage spaces 843 and 844 are communicated with the second storage unit first space S4 through a second communication hole 845 provided in a second connection surface 843*c*. Therefore, the detergent entering the storage spaces of the second cover body 841 through the second detergent inlet 842 is moved to the second storage unit first space S4 through the second communication hole 845. Since the structure of the second cover bottom 843 is the same as that of the first cover bottom 743, its detailed description will be omitted.

The second detergent supply unit 8 includes a second siphon formation pipe 846 coupled to the second body first discharge pipe 817 provided in the second storage body 811 to guide siphon. Since a function and shape of the second siphon formation pipe 846 are the same as those of the first siphon formation pipe 746, their detailed description will be omitted.

Meanwhile, the second detergent supply unit 8 further includes a second cover water supply inlet 848 for preventing the detergent from remaining in the second cover bottom 843. The second cover water supply inlet 848 is provided to implement the same effect as that of the cover water supply inlet 748 of the first detergent supply unit.

The second connection pipe 87 is provided to connect the second body second discharge pipe 816 with a second detergent inlet pipe 412 provided in the tub body. The second body second discharge pipe 816 may include a second storage unit first backward flow preventer 88, and the second detergent inlet pipe 412 may include a second storage unit second backward flow preventer 89. The second storage unit first backward flow preventer 88 and the second storage unit second backward flow preventer 89 may be provided to have the same structure of the aforementioned first backward flow preventer 78 and the aforementioned second backward flow preventer 79.

FIG. 11 illustrates another example of the laundry treating apparatus 100 according to the present invention.

The laundry treating apparatus provided in this embodiment is different from that provided in the embodiment of FIG. 1 in that the first treating apparatus A is arranged above the second treating apparatus B.

The second treating apparatus shown in FIG. 1 and the second treating apparatus B shown in FIG. 11 may be provided to have the same structure, and FIG. 11 illustrates that the second treating apparatus B is provided for washing of laundry as an example.

The second treating apparatus B may include a second cabinet 91 that can support the cabinet 1 of the first treating apparatus A, a second tub 92 provided inside the second cabinet, for storing water therein, and a second drum 94 rotatably provided inside the second tub.

A second cabinet inlet 911 opened or closed by a second door 913 is provided on a front surface of the second cabinet 91. The second tub 92 may be provided in a hollow cylindrical shape, and a second tub inlet 921 is provided on a front surface of the second tub 92. The second cabinet inlet 911 and the second tub inlet 921 may be connected with each other through a gasket 925 to prevent water leakage from occurring.

The second tub 92 may be fixed into the second cabinet 91 through a second tub support unit 923. The second tub 92 is supplied with water through a second water supply pipe 926, and the water stored in the second tub 92 is discharged to the outside of the second cabinet 91 through a second drainage unit 927. The second tub water supply pipe 926 is opened or closed by a second tub water supply pipe valve 929 controlled by a controller (not shown) of the second treating apparatus.

The second drum 94 may be provided in a hollow cylindrical shape, and may be provided with a second drum inlet 941 at the front, wherein the second drum inlet 941 is communicated with the second cabinet inlet 911 and the second tub inlet 921.

An inner space of the second drum 94 is communicated with an inner space of the second tub 92 through a second drum through hole 943. The second drum 94 is rotated by a second driving unit that may include a second stator 945, a second rotor 946, and a second rotary shaft 947 for connecting the second drum with the second rotor by passing through a rear surface of the second tub. The second rotary shaft 947 may be provided in parallel with a bottom of the second cabinet 91.

If the first treating apparatus A provided in the present invention is provided to support the bottom of the second treating apparatus B (FIG. 1), the first treating apparatus A may be provided as described with reference to FIGS. 1 to 10.

However, if the first treating apparatus A is provided to be mounted on the second treating apparatus B as shown in FIG. 11, the first treating apparatus A provided in this embodiment may include a cabinet 1, a tub 2 provided inside the cabinet, for storing water therein, a drum 6 rotatably provided inside the tub, for storing laundry therein, and a first detergent supply unit 7 and a second detergent supply unit 8 for supplying a detergent to the tub. That is, if the laundry treating apparatus is configured as shown in FIG. 11, a drawer 2 may be omitted in the first treating apparatus A.

However, in the embodiment of FIG. 11, a cabinet inlet 13 arranged above the door 45 and a cabinet door 15 for opening or closing the cabinet inlet should be provided on an upper surface of the cabinet 1. Moreover, the first fitting hole 255 and the second fitting hole 256 to which the detergent supply units 7 and 8 are fixed should be provided to pass through the upper surface of the cabinet 1. The first fitting hole 255 and the second fitting hole 256 may be provided to be opened or closed by a first fitting hole door (not shown) and a second fitting hole door 19, which are rotatably provided on the upper surface of the cabinet.

Meanwhile, if a sectional area of the first water supply pipe 31 is greater than that of the supply unit water supply pipe 35 or energy required for operation of the first valve 311 is greater than that required for operation of the second valve, the first valve 311 and the second valve 517 are preferably controlled as follows. That is, if water is supplied to the first detergent supply unit 7, it is preferable that the controller controls the first valve 311 to open the first water supply pipe 31 after controlling the second valve 517 to open the supply unit water supply pipe 35. If the sectional area of the first water supply pipe 31 is greater than that of the supply unit water supply pipe 35 or energy required for operation of the first valve 311 is greater than that required for operation of the second valve, and if the first water supply pipe 31 is first opened, a problem may occur in that the second valve 517 fails to open the supply unit water supply pipe 35 due to a water pressure even though a power is supplied to the second valve 517.

On the contrary, if it is intended to block water supply to the first detergent supply unit 7, it is preferable that the controller controls the first valve 311 and the second valve 517 to first close the first water supply pipe 31 through the first valve 311 and then close the supply unit water supply pipe 35 through the second valve 517.

It will be apparent to those skilled in the art that the present invention may be embodied in other specific forms without departing from the spirit and essential characteristics of the invention. Thus, the above embodiments are to be considered in all respects as illustrative and not restrictive. The scope of the invention should be determined by reasonable interpretation of the appended claims and all change which comes within the equivalent scope of the invention are included in the scope of the invention.

What is claimed is:

1. A laundry treating apparatus comprising:

a cabinet;

a drawer configured to insert into and withdraw from the cabinet, the drawer comprising a drawer cover that defines an upper surface of the drawer and that has a cover through hole configured to receive laundry;

a tub disposed in the drawer, the tub defining a space configured to receive water and comprising a tub cover that defines a top side having a tub inlet, the tub inlet being defined under the cover through hole;

a tub door rotatably connected to the tub cover and configured to open and close the tub inlet;

a drum that is provided inside the tub and that defines a top opening configured to receive laundry;

a detergent supply unit that is disposed at the drawer cover and that defines a first detergent space configured to store detergent, the detergent supply unit being configured to be exposed to an outside based on the drawer being withdrawn from the cabinet;

a connection pipe connecting the detergent supply unit to the tub;

a first water supply pipe connected to a water supply source and configured to receive water from the water supply source;

a connector disposed above the drawer cover and connected to the first water supply pipe;

a second water supply pipe connected to the connector and the tub and configured to guide water to the tub; and a supply unit water supply pipe connected to the connector and the detergent supply unit and configured to guide water from the connector to the detergent supply unit.

2. The laundry treating apparatus according to claim 1, wherein the detergent supply unit includes:

a cover unit defining a detergent inlet configured to introduce detergent;

a storage unit arranged below the cover unit, the storage unit defining a space inside the storage unit;

a barrier partitioning the space inside the storage unit into a first space configured to store the detergent introduced through the detergent inlet and a second space separated from the first space;

a storage unit water supply inlet connected to the supply unit water supply pipe and configured to supply water to the first space;

a first body through hole defined at a bottom surface of the storage unit, the connection pipe communicating with the first space through the first body through hole;

a first discharge pipe protruding from the first body through hole toward the cover unit;

a second discharge pipe provided at the bottom surface of the storage unit, the connection pipe communicating with the second space through the second discharge pipe;

a siphon formation pipe surrounding the first discharge pipe, the siphon formation pipe configured to move liquid inside the first space to the first body through hole based on a liquid level inside the first space being above an upper end of the first discharge pipe; and a space communication unit provided on the barrier configured to move the liquid inside the first space to the second space based on the liquid not being discharged to an outside of the first space through the first body through hole.

3. The laundry treating apparatus according to claim 2, wherein the space communication unit includes a barrier through hole that passes through the barrier and that is defined at the barrier at a location vertically above the upper end of the first discharge pipe and below the detergent inlet.

4. The laundry treating apparatus according to claim 2, wherein the barrier protrudes toward the cover unit from the bottom surface of the storage unit, and wherein the space communication unit comprises a space defined by a free end of the barrier at a location vertically above the first discharge pipe and below the detergent inlet.

5. The laundry treating apparatus according to claim 4, wherein the storage unit water supply inlet passes through a surface of the storage unit that defines the second space together with the barrier, the storage unit water supply inlet being positioned above the free end of the barrier and below the detergent inlet.

6. The laundry treating apparatus according to claim 4, wherein the cabinet is a first cabinet defining an outlet at a front surface, wherein the drawer further comprises a drawer body configured to withdraw from an inside of the first cabinet to an outside of the first cabinet through the outlet, the drawer body defining a space configured to receive the tub, and the drawer cover defining an upper surface of the drawer body, wherein the cover through hole is defined above the tub inlet, wherein the drawer cover further defines a fitting hole configured to receive the detergent supply unit, and wherein the laundry treating apparatus further comprises:

a second cabinet mounted on an upper surface of the first cabinet;

a second tub provided in the second cabinet, the second tub defining a space configured to receive water;

a second drum rotatably provided inside the second tub and configured to receive laundry;

a second tub water supply pipe configured to guide water supplied from the water supply source to the second tub; and a second tub water supply pipe valve configured to open and close the second tub water supply pipe.

7. The laundry treating apparatus according to claim 6, wherein the cover unit is detachably coupled to the drawer cover and inserted through the fitting hole, and wherein the storage unit is fixed to the drawer cover and arranged below the fitting hole.

8. The laundry treating apparatus according to claim 7, wherein the cover unit includes:

a cover bottom arranged above the storage unit;

a cover side extending from the cover bottom and defining a storage space in the cover unit together with the cover bottom, the cover side being configured to detachably couple to the fitting hole; and a communication hole defined at the cover bottom or the cover side and configured to discharge the detergent from the storage space to the first space.

9. The laundry treating apparatus according to claim 8, further comprising a cover water supply inlet that is defined at and passes through the cover side, the cover water supply inlet being configured to flow at least a portion of water discharged from the storage unit water supply inlet to the storage space of the cover unit.

10. The laundry treating apparatus according to claim 8, further comprising a guide that extends from an edge of the fitting hole toward an inside of the first space, the guide being configured to support the cover side, wherein an end of the guide is arranged between the cover side and the barrier and configured to attenuate a flow velocity of water discharged from the storage unit water supply inlet.

11. The laundry treating apparatus according to claim 6, wherein the first body through hole is configured to discharge the liquid inside the first space to the second discharge pipe, and wherein the connection pipe connects the second discharge pipe to the tub.

12. The laundry treating apparatus according to claim 8, wherein the cover bottom comprises:

a first cover bottom that faces and is spaced apart from the bottom surface of the storage unit;

a second cover bottom that is connected to an upper end of the siphon formation pipe, the second cover bottom being positioned vertically above the first cover bottom;

a connection surface that connects the first cover bottom and the second cover bottom, and wherein the communication hole is defined at the connection surface to discharge the detergent from the storage space to the first space.

13. The laundry treating apparatus according to claim 2, wherein the cover unit includes a cover body that defines an opening at an upper surface, and wherein at least a portion of the opening is the detergent inlet.

14. The laundry treating apparatus according to claim 2, further comprising a spacer arranged between an outer surface of the first discharge pipe and an inner surface of the siphon formation pipe to maintain a distance therebetween.

15. The laundry treating apparatus according to claim 1, wherein the detergent supply unit comprises:

a cover unit comprising a detergent inlet, a cover bottom surface, and a cover side surface that is connected with the cover bottom surface to define a storage space; and a storage unit comprising a body bottom surface, and a body side surface that is connected with the body bottom surface to define a space for accommodating the cover unit, the body side surface having a storage unit water supply inlet;

wherein the cover unit is detachably coupled to the storage unit, and wherein, based on the cover unit being coupled to the storage unit, the cover bottom surface is spaced apart from the body bottom surface, and at least a portion of the cover side surface is disposed to be spaced apart from the body side surface.

16. The laundry treating apparatus according to claim 15, wherein the supply unit water supply pipe is connected to the storage unit water supply inlet defined at the body side surface of the storage unit, and wherein a first side of the connection pipe is connected to a discharge pipe located at the body bottom surface of the storage unit, and a second side of the connection pipe is connected to the tub.

17. The laundry treating apparatus according to claim 16, wherein the second side of the connection pipe is connected to a detergent inlet pipe disposed at a side wall of the tub, and wherein the detergent inlet pipe is disposed at a lower position than a top side of the tub.

18. The laundry treating apparatus according to claim 1, wherein the connector comprises a housing defining a chamber configured to receive water from the first water supply pipe, the housing defining:

a first path connected to the first water supply pipe, the first path being configured to guide water received from the first water supply pipe to the chamber, a second path connected to the second water supply pipe, the second path being configured to guide water inside the chamber to the second water supply pipe, and a third path connected to the supply unit water supply pipe, the third path configured to guide water inside the chamber to the supply unit water supply pipe.

19. The laundry treating apparatus according to claim 18, further comprising a valve configured to open and close the third path, the valve comprising:

a valve housing fixed to an outside of the chamber;

a piston having a first end configured to reciprocate inside the valve housing and a free end configured to reciprocate inside the chamber;

a sealer fixed to the free end of the piston and configured to close the third path;

a spring provided inside the valve housing and configured to provide pressure to the piston to maintain the sealer to close the third path; and a coil configured to move the piston away from the third path to open the third path based on an electric current supplied to the coil.

20. The laundry treating apparatus according to claim 18, further comprising:

a second detergent supply unit that is provided at the upper surface of the drawer and that defines a second detergent space configured to store the detergent, the second detergent supply unit being configured to supply the detergent to the tub through a second connection pipe; and a second supply unit water supply pipe connected to the connector and the second detergent supply unit to guide water from the connector to the detergent supply unit, wherein the housing defines a fourth path connected to the second supply unit water supply pipe, the fourth path being configured to guide water from the chamber to the second supply unit water supply pipe, and wherein the second detergent supply unit is located in an area exposed to the outside when the drawer is withdrawn from the cabinet.

21. The laundry treating apparatus according to claim 20, wherein the first path and the second path are fixed to the housing and arranged along a straight line, wherein the third path is fixed to the housing and arranged along a direction orthogonal to the straight line, and wherein the fourth path is fixed to the housing and arranged along a direction parallel to the straight line.

22. The laundry treating apparatus according to claim 19, wherein the piston is made of metal.

23. The laundry treating apparatus according to claim 20, wherein the tub inlet is configured to communicate with the cover through hole, wherein the drawer cover further defines a first fitting hole and a second fitting hole, and wherein at least a portion of the detergent supply unit is inserted to the first fitting hole, and at least a portion of the second detergent supply unit is inserted to the second fitting hole.

24. The laundry treating apparatus according to claim 23, wherein a portion of the supply unit water supply pipe is connected to the third path of the housing above the drawer cover, and another portion of the supply unit water supply pipe is connected to the detergent supply unit below the drawer cover, and wherein a portion of the second supply unit water supply pipe is connected to the fourth path of the housing above the drawer cover, and another portion of the second supply unit water supply pipe is connected to the second detergent supply unit below the drawer cover.

25. A laundry treating apparatus comprising:

a cabinet;

a drawer configured to insert into and withdraw from the cabinet, the drawer comprising a drawer cover that defines an upper surface of the drawer and that has a cover through hole configured to receive laundry;

a tub disposed in the drawer, the tub defining a space configured to receive water;

a drum that is provided inside the tub and that defines a top opening configured to receive laundry;

a detergent supply unit that is disposed at the drawer cover and that defines a first detergent space configured to store detergent, the detergent supply unit being configured to be exposed to an outside based on the drawer being withdrawn from the cabinet;

a connection pipe connecting the detergent supply unit to the tub;

a first water supply pipe connected to a water supply source and configured to receive water from the water supply source;

a connector disposed above the drawer cover and connected to the first water supply pipe;

a second water supply pipe connected to the connector and the tub and configured to guide water to the tub; and a supply unit water supply pipe connected to the connector and the detergent supply unit and configured to guide water from the connector to the detergent supply unit, wherein the drawer cover further defines a fitting hole, wherein the detergent supply unit is inserted into the fitting hole and coupled to the drawer cover, and wherein the supply unit water supply pipe comprises a first end disposed above the drawer cover and connected to the connector, and a second end disposed below the drawer cover and connected to the detergent supply unit.

* * * * *